US008444444B2

(12) United States Patent
Kitajima

(10) Patent No.: US 8,444,444 B2
(45) Date of Patent: May 21, 2013

(54) CONNECTOR

(75) Inventor: Mitsunori Kitajima, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/206,724

(22) Filed: Aug. 10, 2011

(65) Prior Publication Data

US 2012/0064782 A1 Mar. 15, 2012

(30) Foreign Application Priority Data

Sep. 14, 2010 (JP) ..... 2010-206115

(51) Int. Cl.
*H01R 13/42* (2006.01)

(52) U.S. Cl.
USPC ..... 439/751

(58) Field of Classification Search
USPC ..... 439/751, 82, 78, 79
See application file for complete search history.

(56) References Cited

U.S. PATENT DOCUMENTS

| | | | | | |
|---|---|---|---|---|---|
| 3,008,116 | A | * | 11/1961 | Blanchenot | 439/317 |
| 4,083,022 | A | * | 4/1978 | Nijman | 333/183 |
| 4,422,711 | A | * | 12/1983 | Wolowicz | 439/827 |
| 4,676,579 | A | * | 6/1987 | Ting | 439/825 |
| 4,930,200 | A | * | 6/1990 | Brush et al. | 29/25.42 |
| 4,946,390 | A | * | 8/1990 | Smyers | 439/404 |
| 4,971,579 | A | * | 11/1990 | Mobley et al. | 439/595 |
| 4,992,061 | A | * | 2/1991 | Brush et al. | 439/620.22 |
| 5,101,318 | A | * | 3/1992 | Fife | 361/306.1 |
| 5,263,872 | A | * | 11/1993 | Marpoe et al. | 439/188 |
| 5,725,392 | A | * | 3/1998 | Bianca et al. | 439/590 |
| 5,800,214 | A | * | 9/1998 | Pratt et al. | 439/637 |
| 5,806,239 | A | * | 9/1998 | Wesolowski | 47/39 |
| 5,830,012 | A | * | 11/1998 | Ortega et al. | 439/590 |
| 5,873,752 | A | | 2/1999 | Baskin et al. | |
| 5,967,841 | A | * | 10/1999 | Bianca et al. | 439/590 |
| 6,000,973 | A | * | 12/1999 | Mitra | 439/825 |
| 6,312,296 | B1 | * | 11/2001 | Jones | 439/751 |
| 6,328,576 | B1 | * | 12/2001 | Takahashi | 439/78 |
| 6,413,114 | B2 | * | 7/2002 | Fukamachi | 439/374 |
| 6,688,895 | B1 | * | 2/2004 | Fan | 439/82 |
| 6,997,756 | B2 | * | 2/2006 | Nakamura | 439/751 |
| 7,048,594 | B2 | * | 5/2006 | Tsuchiya | 439/751 |
| 7,048,595 | B2 | * | 5/2006 | Nakamura et al. | 439/751 |

(Continued)

FOREIGN PATENT DOCUMENTS

| | | |
|---|---|---|
| DE | 202005014070 U1 | 12/2005 |
| JP | 6-31083 | 4/1994 |

*Primary Examiner* — Amy Cohen Johnson
*Assistant Examiner* — Vladimir Imas
(74) *Attorney, Agent, or Firm* — Gerald E. Hespos; Michael J. Porco; Matthew T. Hespos

(57) ABSTRACT

A connector (A) is provided with a housing (10) made of synthetic resin, press-fit holes (13) formed through the housing (10) and each having a substantially rectangular cross-sectional shape, and terminal fittings (20) to be inserted into the press-fit holes (13). Each terminal fitting (20) has a first press-fit portion (25) with a substantially rectangular cross-section and brings two substantially parallel flat areas (26) into surface contact with the inner wall of the press-fit hole (13) in a fluid- or liquid-tight manner. The first press-fit portion (25) has first and second bulges (27A, 27B) that locally bulge in forward and backward directions parallel to the two flat areas over the entire areas in a width direction connecting the two flat areas (26) and press the inner wall of the press-fit hole (13) in a fluid- or liquid-tight manner.

11 Claims, 10 Drawing Sheets

U.S. PATENT DOCUMENTS

| | | | | |
|---|---|---|---|---|
| 7,125,285 | B2 * | 10/2006 | Maejima et al. | 439/82 |
| 7,175,481 | B1 * | 2/2007 | Cotton et al. | 439/733.1 |
| 7,255,612 | B2 * | 8/2007 | Noguchi | 439/751 |
| 7,361,031 | B2 * | 4/2008 | Matsumura | 439/82 |
| 7,488,219 | B2 * | 2/2009 | Matsumura | 439/751 |
| 7,699,632 | B2 * | 4/2010 | Hiramatsu | 439/246 |
| 7,704,088 | B2 * | 4/2010 | Sakamoto | 439/246 |
| 7,722,413 | B2 * | 5/2010 | Tonosaki | 439/751 |
| 8,133,075 | B2 * | 3/2012 | Burns et al. | 439/595 |
| 8,210,856 | B2 * | 7/2012 | Suzuki et al. | 439/78 |
| 2005/0159038 | A1 * | 7/2005 | Tsuchiya | 439/352 |
| 2005/0250356 | A1 * | 11/2005 | Matsumura et al. | 439/82 |
| 2006/0068620 | A1 * | 3/2006 | Okamura et al. | 439/79 |
| 2006/0216960 | A1 * | 9/2006 | Chang | 439/74 |
| 2012/0094523 | A1 * | 4/2012 | Hashimoto et al. | 439/374 |

* cited by examiner

CONNECTOR

BACKGROUND OF THE INVENTION

1. Field of the Invention

The invention relates to a connector.

2. Description of the Related Art

Japanese Unexamined Utility Model Publication No. H06-31083 discloses a connector in which terminal fittings are press-fit into press-fit holes of a housing. Each terminal fitting of this connector has a press-fit portion to be press-fit into the press-fit hole and a curved contact portion narrower than the press-fit portion. The housing is formed with grooves that accommodate the contact portions and communicate with the press-fit holes. The terminal fittings are formed with curved groove blocking portions that fit into the grooves and block the grooves.

The groove blocking portions fit into the grooves, but are not in close contact with inner walls of the grooves. More particularly, the groove blocking portions substantially fill up the interiors of the additional grooves and hence function as easy water prevention means, but do not reliably prevent water by completely closing clearances to the inner walls of the grooves. Thus, water penetration and water leakage through the clearances between the grooves and the groove blocking portions cannot be prevented reliably.

The present invention was developed in view of the above situation and an object thereof is to make the interior of a press-fit holes waterproof.

SUMMARY OF THE INVENTION

The invention relates to a connector with a housing and at least one press-fit hole formed through the housing. The press-fit hole has a substantially rectangular cross-section perpendicular to a penetration direction. The connector also has at least one terminal fitting to be inserted into the press-fit hole. The terminal fitting is formed with a press-fit portion with a substantially rectangular cross-section perpendicular to an inserting direction into the press-fit hole. The rectangular press-fit portion has two substantially parallel substantially flat areas disposed in surface contact with inner surfaces of the press-fit hole in a fluid- or liquid-tight manner. The press-fit portion also has at least one bulge that locally bulges in a direction parallel to the two flat areas over substantially the entire area in a direction connecting the two flat areas and presses the inner wall of the press-fit hole in a fluid- or liquid-tight manner.

The two substantially parallel flat areas and the convexly bent area of the bulge contact inner surfaces of the press-fit hole in a fluid- or liquid-tight manner. A reaction force results from pressing of the inner surface of the press-fit hole by the convex area of the bulge. Thus, the surface of the press-fit portion substantially opposite to the convex area is also is pressed against an inner surface of the press-fit hole in a fluid- or liquid-tight manner. Therefore, fluid or water penetration and fluid or water leakage are prevented reliably at the bulge.

The at least one bulge may comprise at least two bulges that bulge toward substantially opposite sides on a projection plane perpendicular to the flat areas. Thus, all four outer surfaces of the press-fit portion come into close contact with the inner surfaces of the press-fit hole in a fluid- or liquid-tight manner to provide high fluidproof or waterproof performance.

The bulge preferably is formed by bending to define a convex area that presses the inner wall of the press-fit hole. Resistance between the bulge and the inner wall of the press-fit portion could increase in the press-fitting process if the bulge had a triangular shape with an edged ridge line. Accordingly, the bulge has a substantially trapezoidal shape on a projection plane parallel to the flat areas and resistance between the bulge and the inner surface of the press-fit hole is low.

A width of the press-fit portion along the longer sides preferably is substantially slightly larger than the lateral dimension of the press-fit hole and preferably is constant over the entire length of the press-fit portion.

The terminal fitting may comprise a terminal connecting portion, a holding portion, a stress relaxing portion and a device connecting portion successively connected one after another The terminal connecting portion preferably is slightly wider than the press-fit hole and a dimension of the terminal connecting portion in forward and backward directions is slightly larger than that of the press-fit hole.

The terminal fitting may comprises an auxiliary press-fit portion that is separate from the press-fit portion and is to be press-fit into the press-fit hole of the housing. The auxiliary press-fit portion may comprise at least one retaining portion that projects laterally out. At least one upper end part of the retaining portion may function as guide that is inclined with respect to the inserting direction of the terminal fitting into the press-fit hole. At least one lower end edge of the retaining portion defines a locking edge.

The terminal fitting may comprise a stopper to stop an insertion of the terminal fitting into the press-fit hole. The stopper preferably is wider than the auxiliary press-fit portion and an upper end edge of the stopper preferably is substantially perpendicular to the inserting direction of the terminal fitting into the press-fit hole.

The terminal fitting preferably has a substantially bilaterally symmetric shape.

These and other objects, features and advantages of the present invention will become more apparent upon reading of the following detailed description of preferred embodiments and accompanying drawings.

DETAILED DESCRIPTION OF THE PREFERRED EMBODIMENTS

Figure 1:
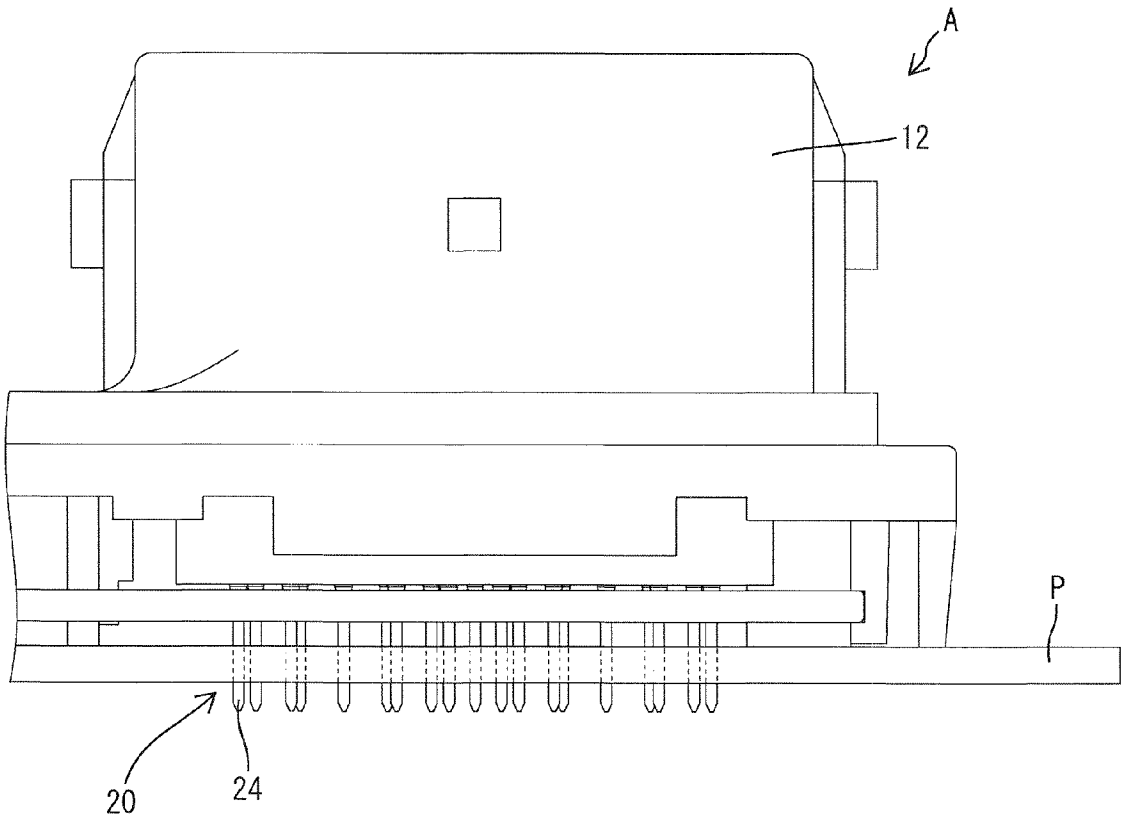
FIG. 1 is a front view showing a state where a connector of a first embodiment is mounted on a circuit board.
Figure 2:
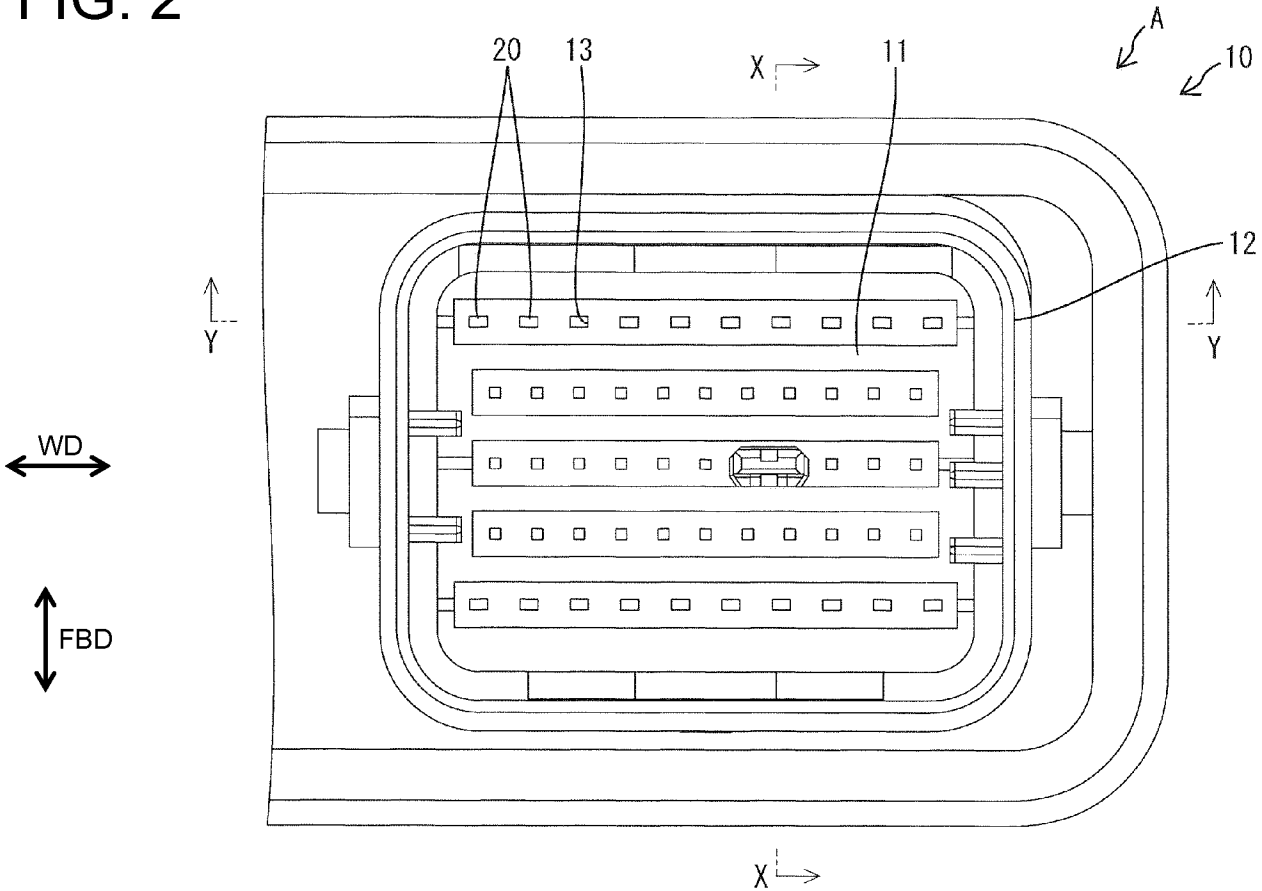
FIG. 2 is a plan view of the connector.
Figure 3:
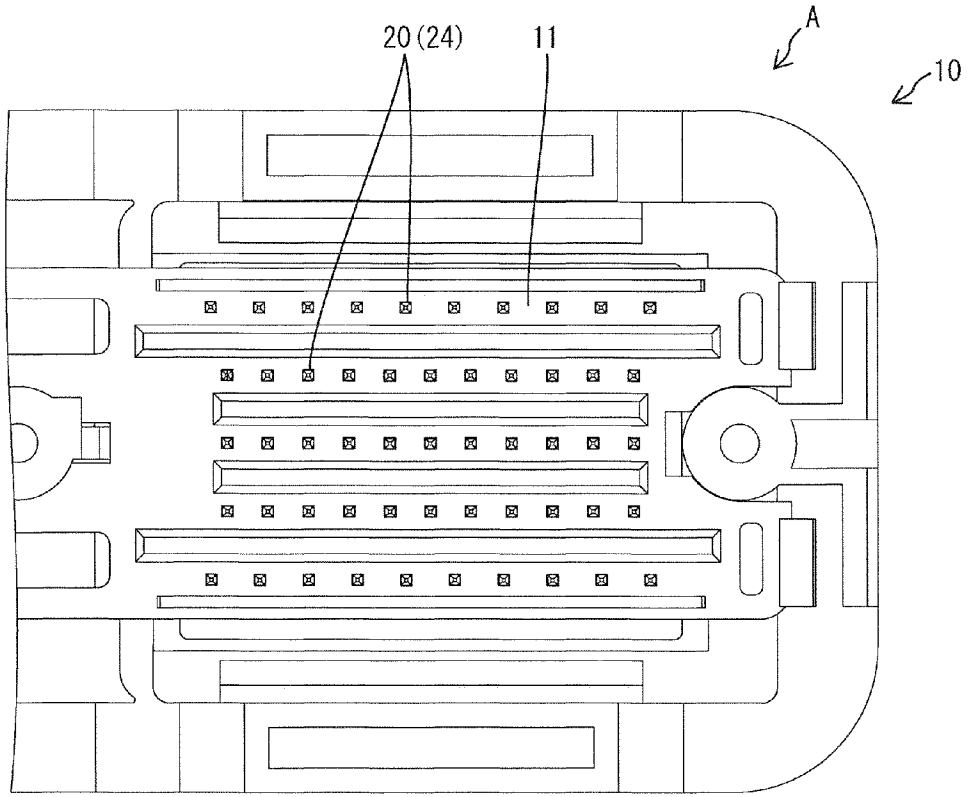
FIG. 3 is a bottom view of the connector.

A connector in accordance with the invention is identified by the letter A in FIGS. 1 to 5. The connector A is to be mounted on a circuit board P and includes a housing 10 made of synthetic resin and a plurality of terminal fittings 20, as shown in FIG. 1. In the following description, forward and backward directions, vertical direction and lateral direction are based on a state where the housing 10 is mounted on the horizontally fixed circuit board P.

Figure 4:
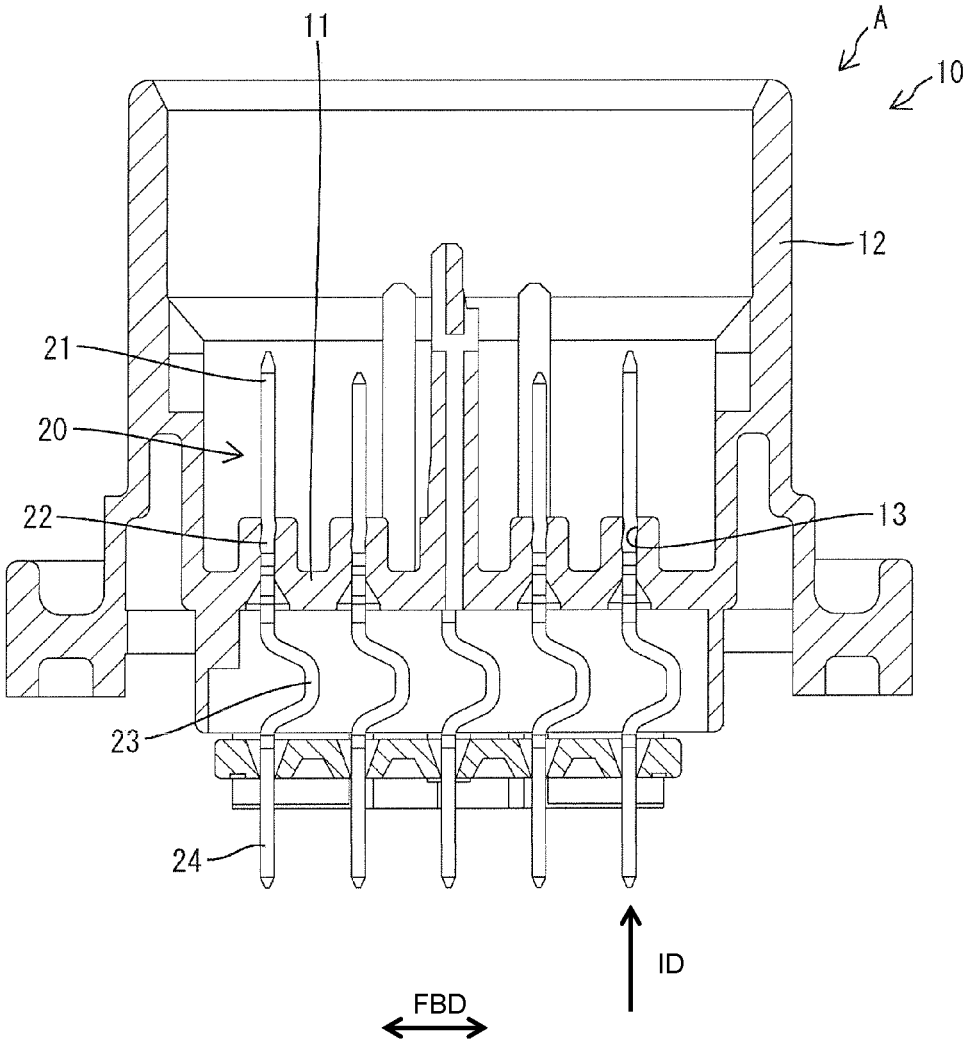
FIG. 4 is a section along X-X of FIG. 2.
Figure 5:
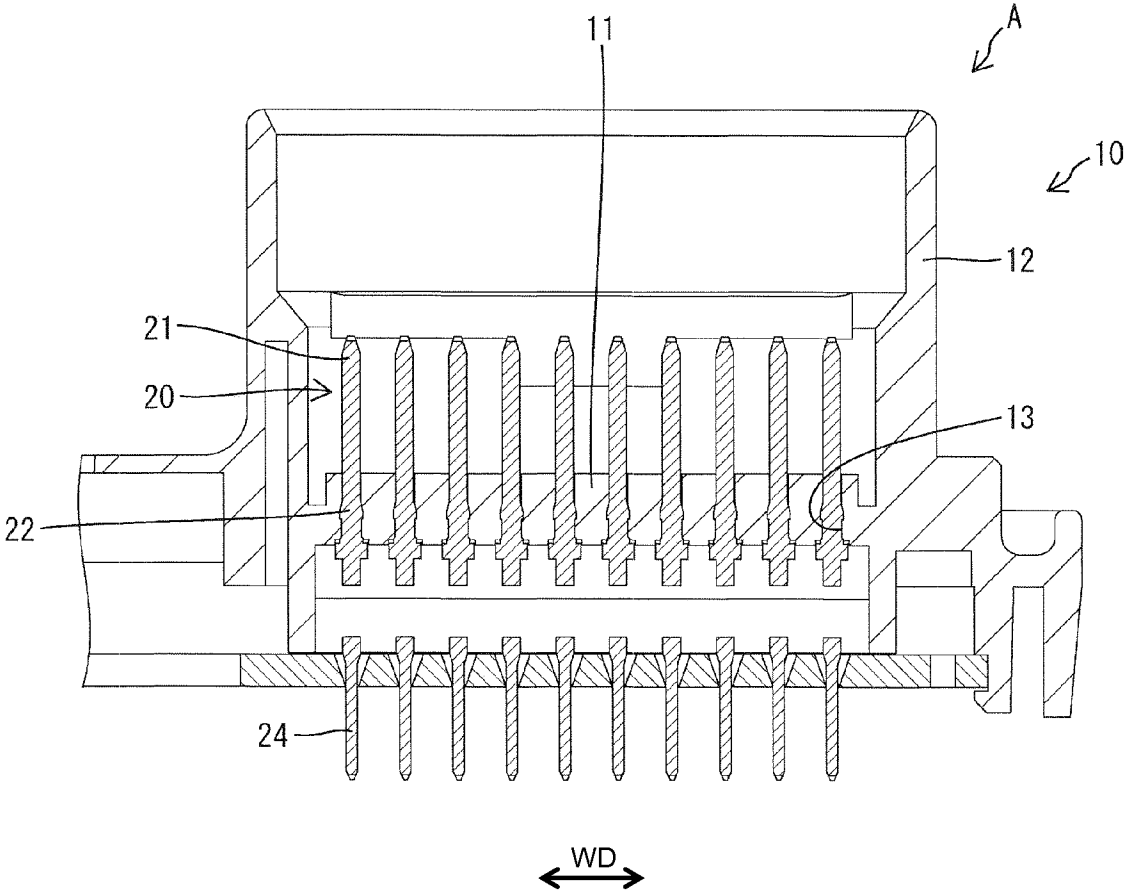
FIG. 5 is a section along Y-Y of FIG. 2.
Figure 9:
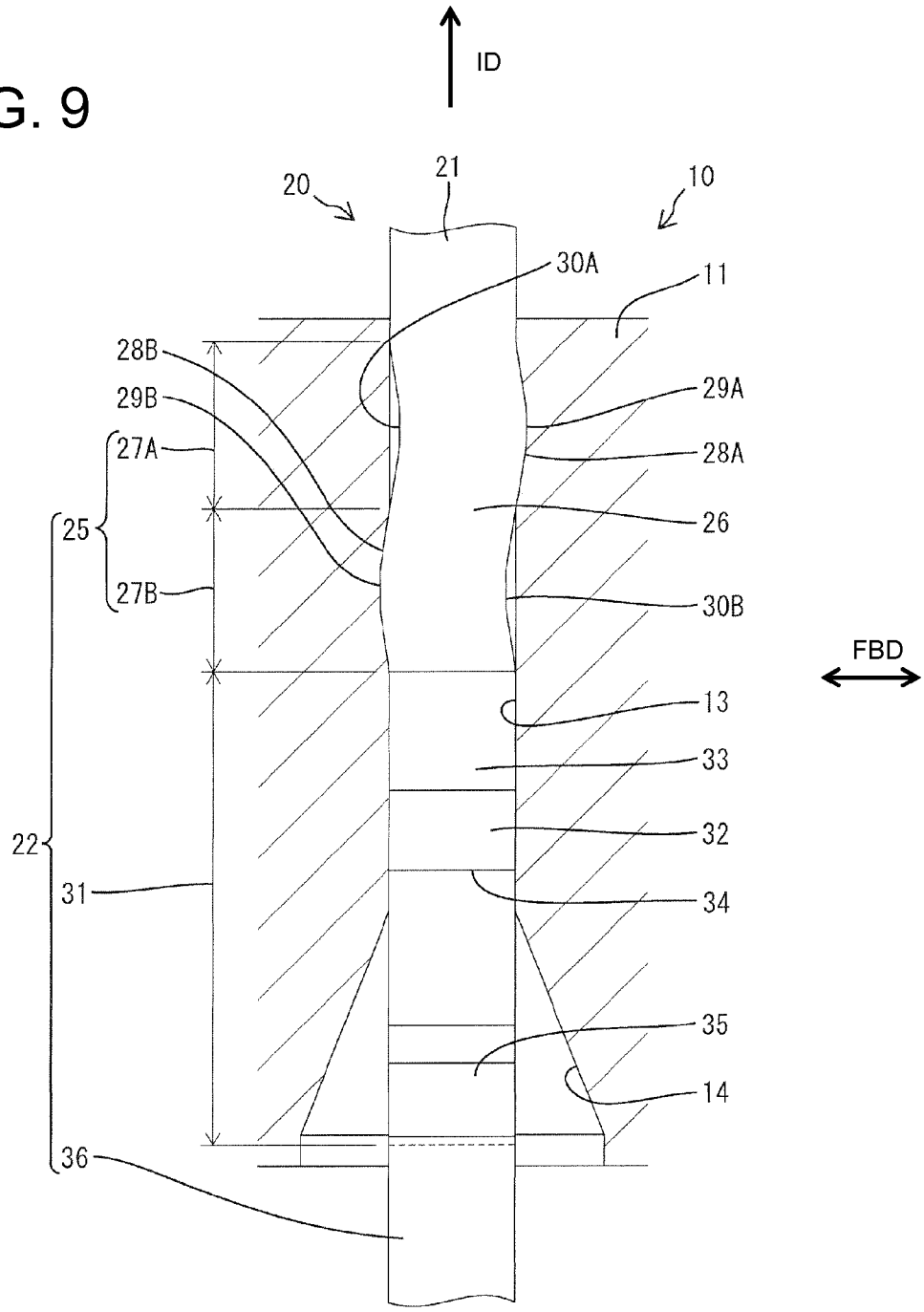
FIG. 9 is a partial enlarged view of FIG. 4 showing a state where the terminal fitting is press-fitted in a press-fit hole.
Figure 10:
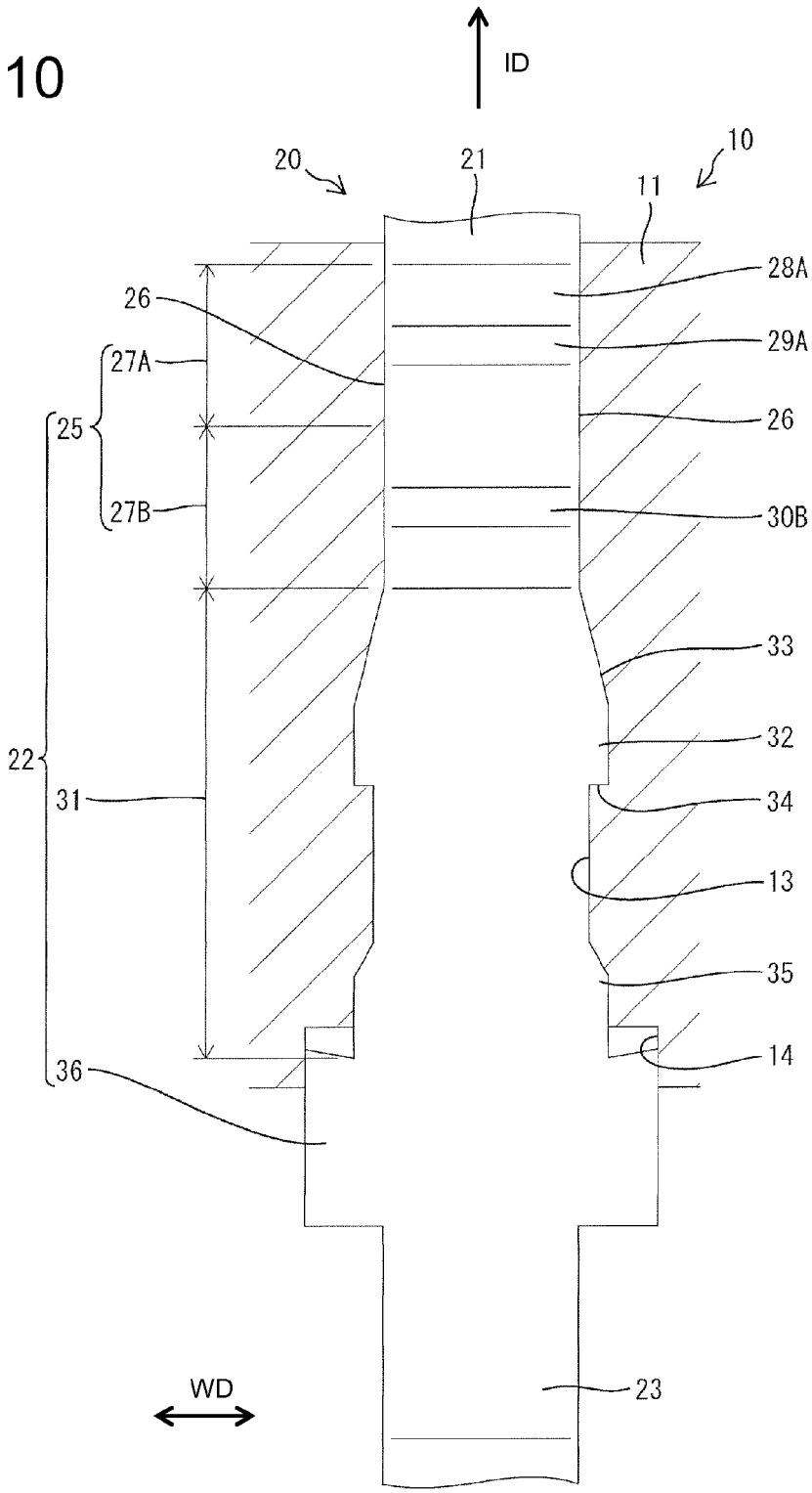
FIG. 10 is a partial enlarged view of FIG. 5 showing the state where the terminal fitting is press-fitted in the press-fit hole.

As shown in FIGS. 4 and 5, the housing 10 is formed unitarily and includes a supporting wall 11 to be oriented substantially parallel to the circuit board P and a receptacle 12 that projects substantially perpendicularly up from a peripheral edge of the supporting wall 11. Press-fit holes 13 penetrate the supporting wall 11 vertically and are arranged in a rectangular pattern extending in a width direction WD and in forward and backward directions FBD. Each press-fit hole 13 has a rectangular cross-sectional shape perpendicular to a penetration direction with the longer sides aligned laterally and in the width direction WD and the shorter sides aligned in forward and backward directions FBD. Cross-sectional dimensions of the press-fit hole 13 are constant over the entire length of the press-fit hole 13 in the penetration direction. Further, as shown in FIGS. 9 and 10, recesses 14 are formed in the lower surface of the supporting wall 11 at edges of the respective press-fit holes 13.

Each terminal fitting 20 is long and narrow in the vertical direction and is formed bending, folding and/or embossing (press-working) a conductive metal plate material punched or cut out into a specified shape. As shown in FIGS. 6 to 10, each terminal fitting 20 has a terminal connecting portion 21, a holding portion 22, a stress relaxing portion 23 and a board connecting portion 24 arranged successively one after another from the top and has a substantially bilaterally symmetric shape.

Figure 6:
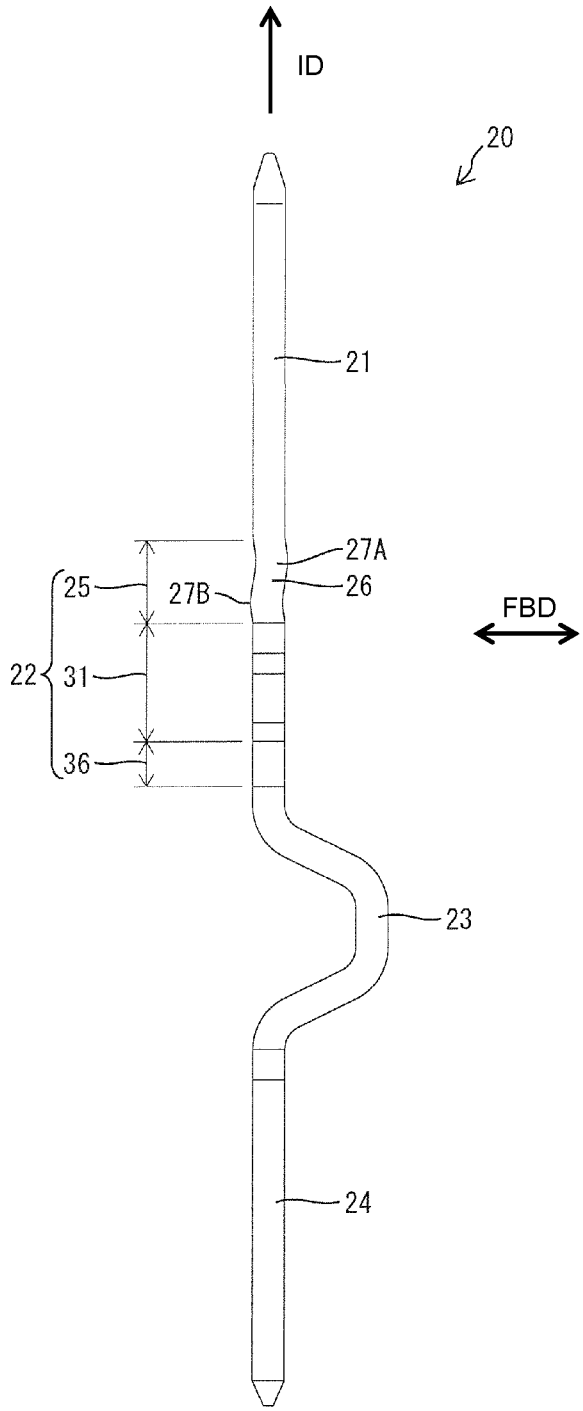
FIG. 6 is a side view of a terminal fitting.
Figure 7:
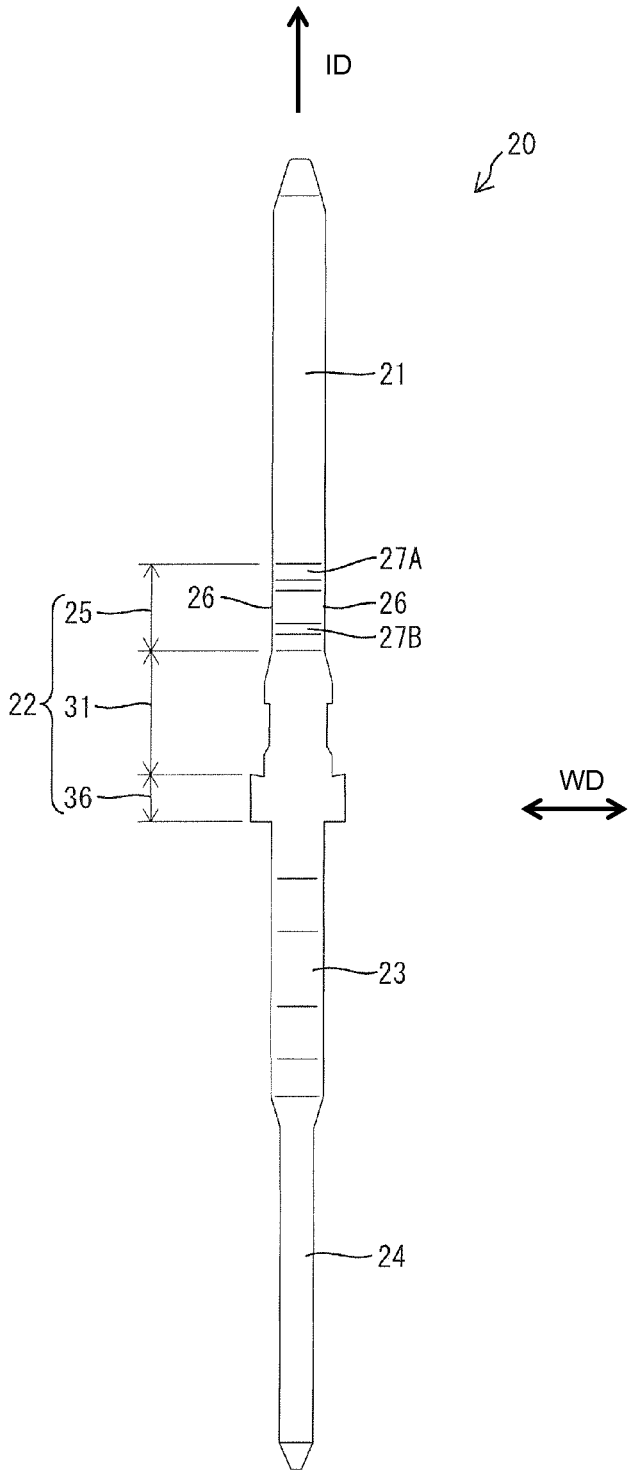
FIG. 7 is a front view of the terminal fitting.

As shown in FIGS. 6 and 7, the terminal connecting portion 21 takes up less than about ⅓ area (particularly about ¼ area) of the terminal fitting 20 at an upper end in the vertical direction and is to be connected electrically conductively to a female mating terminal (not shown). The terminal connecting portion 21 extends substantially straight in the vertical direction and has a rectangular cross-sectional shape with the longer sides aligned in the width direction WD. A width dimension of the terminal connecting portion 21 is slightly larger than the width of the press-fit hole 13 and a dimension of the terminal connecting portion 21 in forward and backward directions FBD is slightly larger than the length of the press-fit hole 13.

The board connecting portion 24 takes up less than about ⅓ area (particularly an about ¼ area) of the terminal fitting 20 at a lower end in the vertical direction and is to be inserted into a through hole or recess (not shown) of the circuit board P. The board connecting portion 24 substantially extends straight in the vertical direction and has a square cross-sectional shape. Dimensions of the board connecting portion 24 in width direction WD and forward and backward directions FBD are substantially equal to the dimension of the terminal connecting portion 21 in forward and backward directions FBD.

The stress relaxing portion 23 extends from the upper end of the board connecting portion 24 and takes up about ¼ of the terminal fitting 20 in the vertical direction. The stress relaxing portion 23 is substantially trapezoidal, omega-shaped, curved or serpentine when viewed sideways (see e.g. FIGS. 4 and 6) and is bent to project forward from the board connecting portion 24. The stress relaxing portion 23 has a substantially rectangular cross-section with the longer sides aligned in the width direction WD. The stress relaxing portion 23 is resiliently deformable in response to a substantially vertical force on the upper and lower ends. This resilient deformation of the stress relaxing portion 23, absorbs a relative displacement to relax stress in a fixed part between the board connecting portion 24 and the through hole in response to a vertical relative displacement between the circuit board P and the housing 10 in a state where the board connecting portion 24 is fixed to the through hole by soldering.

The holding portion 22 joins the lower end of the terminal connecting portion 21 and the upper end of the stress relaxing portion 23 and extends substantially straight in the vertical direction. The holding portion 22 takes up less than about ⅓ (particularly about ¼) of the terminal fitting 20 in the vertical direction. The holding portion 22 substantially has a rectangular cross-section over substantially over the entire length thereof with the longer sides aligned in the width direction WD. As shown in FIGS. 6, 7, 9 and 10, the holding portion 22 has a first press-fit portion 25, a second press-fit portion 31 and a stopper 36 arranged successively in this order from the top. The first and second press-fit portions 25, 31 are to be press-fit into the press-fit hole 13 of the housing 10.

The width of the first press-fit portion 25 along the longer sides is substantially equal to the width of the terminal connecting portion 21, i.e. slightly larger than the width of the press-fit hole 13 and is constant over the entire length of the first press-fit portion 25. Substantially parallel flat areas 26 are defined at the shorter outer surfaces of the first press-fit portion 25 and extend over the entire length of the first press-fit portion 25.

The first press-fit portion 25 comprises a first bulge 27A adjacent the lower end of the terminal connecting portion 21 and a second bulge 27B extending from the lower end of the first bulge 27A. The first bulge 27A bulges forward (direction substantially parallel to the flat areas 26 and substantially perpendicular to a pressing direction into the press-fit hole 13) to have a substantially trapezoidal, bent or serpentine shape on a projection plane parallel to the flat areas 26 and projected in a direction perpendicular to the flat areas 26 (see FIG. 9).

The bulging direction is substantially parallel to a thickness direction of the first press-fit portion 25 and to the forward and backward directions FBD. The first bulge 27A is formed continuously over the entire area in the lateral direction, which connects the left and right flat areas 26 and is perpendicular to the flat areas 26. As shown in FIGS. 9 and 10, a first ridge 29A defines a maximum bulging area of the first bulge 27A and extends perpendicular to the inserting direction ID into the press-fit hole 13.

The first bulge 27A has a first convex area 28A at the front outer surface and a first concave area 30A opposite the first convex area 28A. The first convex area 28A and the first concave area 30A are substantially trapezoidal, bent or serpentine when viewed sideways. The thickness of the first bulge in forward and backward directions before being bent is equal to the thickness of the terminal connecting portion 21.

The second bulge 27B bulges back substantially parallel to the flat areas 26, substantially perpendicular to the pressing direction into the press-fit hole 13 and substantially opposite to the bulging direction of the first bulge 27A to have a substantially trapezoidal, bent or serpentine shape on the projection plane (see FIG. 9) substantially parallel to the flat areas 26. The bulging direction is substantially parallel to the thickness direction of the first press-fit portion 25. The second bulge 27B is formed continuously over the entire area in the lateral direction connecting the left and right flat areas 26 and perpendicular to the flat areas 26. A second ridge 29B defines a maximum bulging area of the second bulge 27B extends in the width direction WD perpendicular to the inserting direction ID into the press-fit hole 13. The first and second bulges 27A and 27B are connected vertically to form a wavy or serpentine shape that is convex and concave in forward and backward directions FBD.

As shown in FIG. 9, a second convex area 28B is defined at the rear of the second bulge 27B. This second convex area 28B is substantially trapezoidal, bent or serpentine when viewed sideways. A second concave area 30B is defined on the second bulge 27B opposite the second convex area 28B and is substantially trapezoidal, bent or serpentine. The thickness of the second bulge 27B in forward and backward directions FBD before being bent is substantially equal to the thicknesses of the first bulge 27A and the terminal connecting portion 21.

The thickness of the second press-fit portion 31 in forward and backward directions is substantially constant over the entire length and is equal to the thickness of the first press-fit portion 25 before being bent and the thickness of the terminal connecting portion 21 on a laterally projected projection plane. As shown in FIG. 10, retaining portions 32 project out to the left and right in an upper end part of the second press-fit portion 31. Guides 33 are defined at upper ends of outer side surfaces of the retaining portions 32 and are inclined with respect to the vertical pressing direction into the press-fit hole 13 and locking edges 34 are defined at lower end edges of the retaining portions 32. A widened portion 35 is formed in a lower end part of the second press-fit portion 31 and bulges out to the left and right. The upper part of the second press-fit portion 31 including the retaining portions 32 is wider than the first press-fit portion 25 and the lower end part of the second press-fit portion 31 including the widened portion 35 also is wider than the first press-fit portion 25. The stopper 36 is wider than the second press-fit portion 31 and the upper end edge of the stopper is substantially perpendicular to the pressing direction into the press-fit hole 13.

The terminal fitting 20 is inserted into the press-fit hole 13 from below and along the inserting direction ID to mount the terminal fitting 20 into the supporting wall 11. More particularly, the terminal connecting portion 21 initially is press-fit into the press-fit hole 13 and then the first bulge 27A of the first press-fit portion 25 is press-fit into the press-fit hole 13. In this process of press-fitting the first bulge 27A, the left and right flat areas 26 of the first bulge 27A slide in close contact with the left and right surfaces of the inner wall of the press-fit hole 13 in a fluid- or liquid-tight manner and the first convex area 28A of the first bulge 27A slides in close contact with the front surface of the inner wall of the press-fit hole 13 in a fluid- or liquid-tight manner. The second bulge 27B then is press-fit into the press-fit hole 13. In this process of press-fitting the second bulge 27B, the left and right flat areas 26 of the second bulge 27B slide in close contact with the left and right surfaces of the inner wall of the press-fit hole 13 in a fluid- or liquid-tight manner and the second convex area 28B of the second bulge 27B slides in close contact with the rear surface of the inner wall of the press-fit hole 13 in a fluid- or liquid-tight manner.

In a state where both the first and second bulges 27A, 27B are located in the press-fit hole 13, the first convex area 28A of the first bulge 27A presses the front inner wall surface of the press-fit hole 13 and the second convex area 28B of the second bulge 27B presses the rear inner wall surface of the press-fit hole 13. Thus, the two bulges 27A, 27B press the inner wall surfaces of the press-fit hole 13 in opposite directions, and a degree of close contact between the bulges 27A, 27B and the inner wall surfaces of the press-fit hole 13 in forward and backward directions FBD is increased. Further, the first ridge 29A of the first convex area 28A and the second ridge 29B of the second convex area 28B are both in surface contact with the inner wall surfaces of the press-fit hole 13.

The second press-fit portion 31 is press-fit into the press-fit hole 13 after the entire second bulge 27B is inserted into the press-fit hole 13. The upper end edge of the stopper 36 contacts the back end surface of the recess 14 when the terminal fitting 20 reaches a specified mount position in the supporting wall 11, thereby preventing any further insertion of the terminal fitting 20. Further, the locking edges 34 at the lower ends of the retaining portions 32 bite into the inner wall surfaces of the press-fit hole 13 to prevent a movement of the terminal fitting 20 down in a withdrawing direction. In this way, the terminal fitting 20 is held at a proper assembled position.

As described above, each terminal fitting 20 of the connector A is formed with the first press-fit portion 25 that has a substantially rectangular cross-sectional shape perpendicular to the inserting direction ID into the press-fit hole 13 and brings the two parallel flat areas 26 into surface contact with the inner walls of the press-fit hole 13 in a liquid-tight manner. The first press-fit portion 25 is formed with the first and second bulges 27A, 27B that locally bulge in forward and backward directions FBD parallel to the two flat areas 26 substantially over the entire areas in the width direction WD connecting the two flat areas 26 and press the inner wall of the press-fit hole 13 in a liquid-tight manner.

According to this construction, the two substantially parallel flat areas 26 and the convex areas 28A, 28B contact the inner wall of the press-fit hole 13 in a fluid- or liquid-tight manner. Reaction forces of the convex areas 28A, 28B pressing the inner wall of the press-fit hole 13 cause the surfaces of the first press-fit portion 25 substantially opposite to the convex areas 28A, 28B (the second convex area 28B when the reaction force at the first convex area 28A is focused and the first convex area 28A when the reaction force at the second convex area 28B is focused) also are pressed against the inner wall of the press-fit hole 13 in a fluid- or liquid-tight manner. Therefore, the bulges 27A, 27B reliably prevent fluid or water penetration and leakage.

Figure 8:
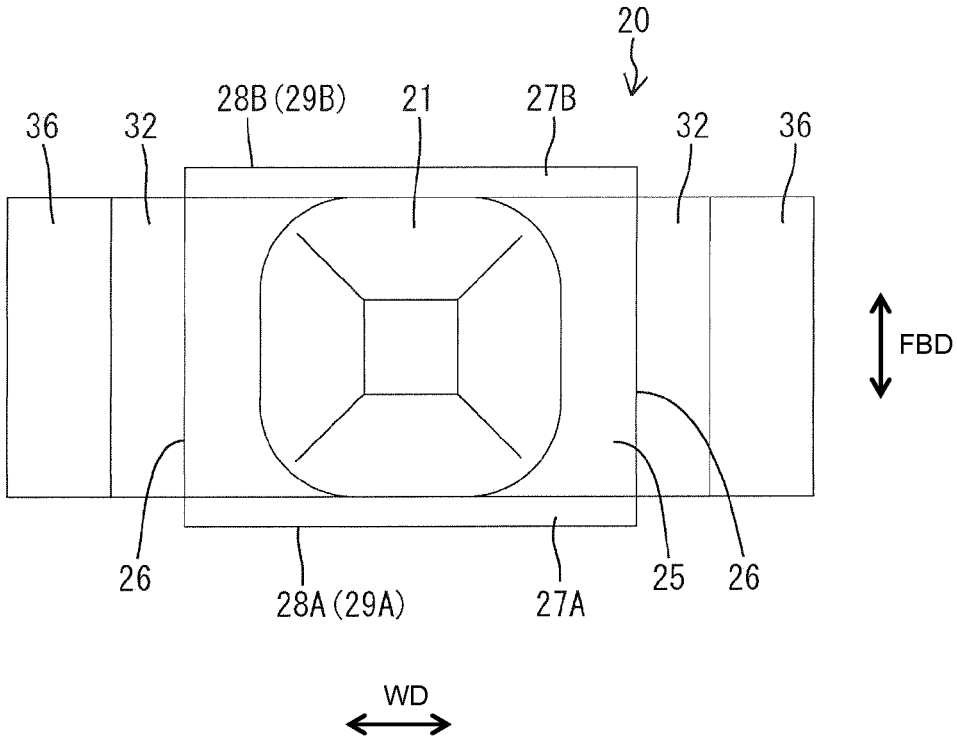
FIG. 8 is a plan view of the terminal fitting.

As shown in FIG. 8, the two bulges 27A, 27B bulge toward the opposite sides on the projection plane perpendicular to the flat areas 26. Thus, all four outer surfaces of the first press-fit portion 25 are held in close contact with the inner wall of the press-fithole 13 in a fluid- or liquid-tight manner to provide a high waterproof performance.

If the bulge had a triangular shape with an edged ridge line, resistance between the ridge line of the bulge and the inner wall of the press-fit hole increases in the press-fitting process could cause a problem in the press-fitting operation. However, the bulges 27A, 27B are formed by bending so that the convex areas 28A, 28B define substantially trapezoidal, bent or serpentine shapes. Thus, resistance between the bulging portions 27A, 27B and the inner wall of the press-fit hole 13 is suppressed to a low level.

The invention is not limited to the above described and illustrated embodiment. For example, the following embodiments are also included in the scope of the invention.

Although an application to the board connector to be mounted on the circuit board is described in the above embodiment, the present invention is also applicable to connectors (e.g. joint connectors) that cannot be mounted on circuit boards.

Although the ridge lines of the bulges extend in the width direction perpendicular to the inserting direction into the press-fit hole in the above embodiment, they may extend in directions oblique to the width direction.

The press-fit portion is formed with two bulges in the above embodiment, but more or fewer bulges may be formed.

The two bulges bulge in opposite directions in the above embodiment, but all of the bulges may bulge in the same direction.

One bulge has a trapezoidal shape to come into surface contact with the inner wall of the press-fit hole in the above embodiment. However, the bulge may have an arcuately curved shape defined only by a curve or may have a triangular shape with an edged ridge line.

Although the press-fit portion has a rectangular cross-sectional shape and the bulges thereof project in the thickness direction in the above embodiment. However, the bulges may bulge in the width direction (direction perpendicular to the thickness direction) in the press-fit portion having a rectangular cross-sectional shape.

Although the press-fit portion has a rectangular cross-sectional shape in the above embodiment, it may have a square cross-sectional shape.

What is claimed is:

1. A connector, comprising:

a housing having at least one press-fit hole with a substantially rectangular cross-section perpendicular to a penetration direction; and at least one terminal fitting inserted into the press-fit hole, the terminal fitting having at least one press-fit portion with a substantially rectangular cross-section perpendicular to an inserting direction into the press-fit hole, the press-fit portion having two substantially flat side surfaces substantially parallel to each other and disposed in surface contact with inner surfaces of the press-fit hole in a fluid-tight manner, the press-fit portion further having front and rear surfaces aligned substantially parallel to one another and extending between the side surfaces, the press-fit portion being formed so that front and rear convex bulges are formed respectively on the front and rear surfaces at positions spaced apart along the inserting direction, the front and rear bulges bulging in directions parallel to the two flat side surfaces and extending over entire areas of the front and rear surfaces in directions connecting the two flat side surfaces, a rear concave area formed on the rear surface at a position opposite the front convex bulge and a front concave area formed on the front surface at a position opposite the rear convex bulge, wherein the front and rear convex bulges press the inner surfaces of the press-fit hole in a fluid-tight manner.

2. The connector of claim 1, wherein the bulge is formed by bending to define convex areas that press the inner wall of the press-fit hole.

3. The connector of claim 1, wherein a width of the press-fit portion along the longer sides is slightly larger than the lateral dimension of the press-fit hole and is constant over the entire length of the press-fit portion.

4. The connector of claim 1, wherein the terminal fitting comprises a terminal connecting portion, a holding portion, a stress relaxing portion and a device connecting portion successively connected one after another.

5. The connector of claim 4, wherein the terminal connecting portion is wider than the press-fit hole and slightly longer than the press-fit hole in forward and backward directions.

6. The connector of claim 1, wherein the terminal fitting comprises an auxiliary press-fit portion separate from the press-fit portion and configured to be press-fit into the press-fit hole of the housing.

7. The connector of claim 6, wherein auxiliary press-fit portion comprises at least one retaining portion laterally projecting outward, a guide being defined on an outer side surface of the retaining portion and being inclined with respect to the inserting direction of the terminal fitting into the press-fit hole and a locking edge being defined on a part of the retaining portion opposite the guide.

8. The connector of claim 1, wherein the terminal fitting comprises a stopper to stop an insertion of the terminal fitting into the press-fit hole.

9. The connector of claim 8, wherein the stopper is wider than an auxiliary press-fit portion and an upper end edge of the stopper is substantially normal to the inserting direction of the terminal fitting into the press-fit hole.

10. The connector of claim 1, wherein the terminal fitting substantially has a bilaterally symmetric shape.

11. A terminal fitting comprising: a terminal connecting end; a board connecting end; and a press-fit portion of substantially rectangular cross-section between the ends, the press-fit portion having two substantially flat side surfaces substantially parallel to each other and front and rear surfaces aligned substantially parallel to one another and extending between the side surfaces, the press-fit portion being formed so that front and rear convex arcuate bulges are formed respectively on the front and rear surfaces at different respective positions between the terminal connecting end and the board connecting end and bulging in opposite directions substantially parallel to the two flat side surfaces and extending over an entire area between the two flat side surfaces, a rear concave area formed on the rear surface at a position opposite the front convex bulge and a front concave area formed on the front surface at a position opposite the rear convex bulge.

* * * * *